US009334867B2

(12) United States Patent
Aiello et al.

(10) Patent No.: US 9,334,867 B2
(45) Date of Patent: May 10, 2016

(54) FAN PERFORMANCE BY INCREASING EFFECTIVE BLADE HEIGHT IN A TOLERANCE NEUTRAL MANNER

(71) Applicant: Apple Inc., Cupertino, CA (US)

(72) Inventors: Anthony Joseph Aiello, Santa Cruz, CA (US); Jesse T. Dybenko, Cupertino, CA (US); Richard A. Herms, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 292 days.

(21) Appl. No.: 13/887,184

(22) Filed: May 3, 2013

(65) Prior Publication Data

US 2014/0301828 A1 Oct. 9, 2014

Related U.S. Application Data

(60) Provisional application No. 61/809,815, filed on Apr. 8, 2013.

(51) Int. Cl.

| | |
|---|---|
| ***F04D 17/16*** | (2006.01) |
| ***F04D 25/06*** | (2006.01) |
| ***F04D 29/42*** | (2006.01) |
| ***F04D 29/44*** | (2006.01) |

(52) U.S. Cl.
CPC ..... *F04D 17/16* (2013.01); *F04D 25/062* (2013.01); *F04D 29/4226* (2013.01); *F04D 29/441* (2013.01)

(58) Field of Classification Search
CPC ..... F04D 19/00; F04D 19/002; F04D 29/26; F04D 29/28; F04D 29/281; F04D 29/282; F04D 29/32; F04D 29/325; F04D 29/38; F04D 29/4226; F04D 29/441; F04D 17/16
See application file for complete search history.

(56) References Cited

U.S. PATENT DOCUMENTS

| | | | | |
|---|---|---|---|---|
| 6,132,170 | A * | 10/2000 | Horng | 415/178 |
| 7,258,488 | B2 * | 8/2007 | Shih et al. | 384/119 |
| 2008/0213103 | A1 | 9/2008 | Miyakoda et al. | |
| 2009/0226334 | A1 * | 9/2009 | Li et al. | 417/353 |
| 2010/0232957 | A1 * | 9/2010 | Horng | 415/208.1 |
| 2010/0290901 | A1 | 11/2010 | Kim et al. | |

FOREIGN PATENT DOCUMENTS

| | | |
|---|---|---|
| JP | 10153194 | 6/1998 |
| JP | 2004092446 | 3/2004 |

OTHER PUBLICATIONS

PCT Application No. PCT/US2014/032587—International Search Report & Written Opinion dated Jul. 30, 2014.

* cited by examiner

*Primary Examiner* — Nathaniel Wiehe
*Assistant Examiner* — Michael Sehn
(74) *Attorney, Agent, or Firm* — Downey Brand LLP

(57) ABSTRACT

The described embodiments relate generally to improving performance characteristics of a low profile fan. More specifically configurations having sloped fan blade edges are disclosed. By applying a gradual slope to each of the fan blades, performance of the fan can be increased without risking contact or rubbing between the fan blades and a fan housing. In some embodiments, the sloped fan blades can be configured to prevent contact when bearings of the fan include a certain amount of tilt play.

15 Claims, 8 Drawing Sheets

Parallel Blade

Optimally Sloped Blade

Excessively Sloped Blade

Dual-Sloped Blade

FAN PERFORMANCE BY INCREASING EFFECTIVE BLADE HEIGHT IN A TOLERANCE NEUTRAL MANNER

CROSS-REFERENCE TO RELATED APPLICATIONS

This application claims the benefit of U.S. Provisional Patent Application No. 61/809,815, filed Apr. 8, 2013, and entitled "METHOD FOR IMPROVING FAN PERFORMANCE BY INCREASING EFFECTIVE BLADE HEIGHT IN A TOLERANCE NEUTRAL MANNER", which is incorporated herein by reference in its entirety for all purposes.

BACKGROUND

1. Technical Field

The described embodiments relate generally to improving performance characteristics of a low profile fan. More specifically configurations having sloped fan blade edges are disclosed.

2. Related Art

Successive generations of portable electronic devices are generating increasingly high amounts of heat within increasingly smaller device housings. To dissipate this heat, cooling systems with higher heat rejection capabilities are desired. One efficient cooling system commonly used with portable computing devices is a fan.

Therefore, what is desired is a reliable way to increase the efficiency of a fan without increasing its size or acoustic profile.

SUMMARY

This paper describes various embodiments that relate to improving performance characteristics of a fan.

In one embodiment a centrifugal fan assembly is disclosed. The centrifugal fan assembly is configured to cool a computing device. The centrifugal fan assembly includes a fan assembly housing having a top cover. The centrifugal fan assembly also includes a rotor. The rotor, in turn, includes at least the following: a shaft mechanically coupled to a rotational drive, the rotational drive configured to impart a rotational force on the shaft, causing the shaft to rotate at a rotational velocity; and an impeller centrally attached to the shaft. The impeller includes at least a fan blade at an outside perimeter of the impeller. The fan blade includes a leading edge, a trailing edge and a top edge disposed between the leading and trailing edges. The top edge is characterized by a top slope $S_{top}$ that prevents contact between the top edge and the top cover. The top slope $S_{top}$ corresponds to a height of the leading edge being greater than that of the trailing edge.

In another embodiment a rotor assembly is disclosed. The rotor assembly includes at least the following: a shaft mechanically coupled to a rotational drive, the rotational drive configured to impart a rotational force on the shaft, causing the shaft to rotate at a rotational velocity; and an impeller centrally attached to the shaft. The impeller includes at least a fan blade at an outside perimeter of the impeller. The fan blade includes a leading edge, a trailing edge, and a bottom edge. The bottom edge is characterized as having a bottom slope $S_{bottom}$ that prevents contact between the bottom edge and an associated fan housing having an air inlet disposed proximate to the bottom edge. The bottom slope $S_{bottom}$ corresponds to a height of the leading edge being greater than a height of the trailing edge of the blade.

In yet another embodiment a fan assembly is disclosed. The fan assembly includes a housing having a top cover through which an air inlet is disposed. The fan assembly also includes an impeller. The impeller is supported by bearings that are configured to constrain the impeller to a single axis of rotation during operation of the fan assembly. The impeller includes a fan blade configured to draw air into the air inlet and to blow air back out of an air outlet. The fan blade includes both a leading edge and a trailing edge. The leading edge has a height greater than the trailing edge. The fan blade also includes a top surface disposed between the leading edge and the trailing edge. The top surface has a top slope $S_{top}$ that maximizes blade area of the fan blade disposed outboard of the air inlet while preventing contact between the top surface and the top cover.

Other aspects and advantages of the invention will become apparent from the following detailed description taken in conjunction with the accompanying drawings which illustrate, by way of example, the principles of the described embodiments.

BRIEF DESCRIPTION OF THE DRAWINGS

The described embodiments may be better understood by reference to the following description and the accompanying drawings. Additionally, advantages of the described embodiments may be better understood by reference to the following description and accompanying drawings in which.

DETAILED DESCRIPTION OF SELECTED EMBODIMENTS

Figure 1A:
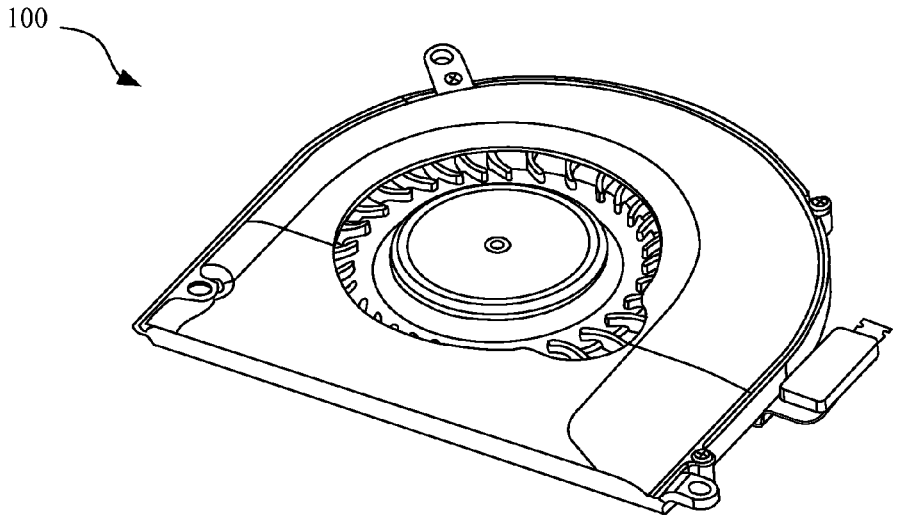
FIGS. 1A-1B show an exemplary high performance centrifugal cooling fan.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

It is advantageous for notebook computers to be as slim and light as possible to facilitate their mobility. For this reason, the internal space allocated to the cooling system is constantly under pressure to be reduced, so the optimization of cooling capacity per unit volume is the subject of much study and effort in the development of notebook computers. This goal typically drives the design of the cooling fan to be as thin as possible without compromising airflow and acoustic performance. It is desirable to create a fan design that can be thinner while maintaining the same airflow and acoustic sound level.

The disclosed embodiments seek to increase the airflow of a slim, notebook cooling fan without increasing the overall height of the fan, without compromising the acoustic performance of the fan or requiring costly tightening of the fan's component part and assembly tolerances. This is accomplished by sloping the top and/or bottom edges of the fan blades by a specific amount that is a function of the tilt play in the fan bearing system and the relative diameters of the fan blade leading edges, trailing edges and the inlet cover opening.

In order to preserve manufacturing and assembly costs the described changes can be made in a tolerance-neutral manner. By tolerance-neutral it is meant that no changes to manufacturing or assembly processes must be made to accommodate the changes. This can be highly advantageous as tightening of tolerances can substantially raise a per unit cost of the fans. Moreover, in addition to tolerance neutrality, the described fan assemblies provided improved and more efficient performance in that airflow can be maximized while maintaining the same or better acoustic performance.

Generally speaking, a fan assembly can include a shaft and impeller arrangement mechanically coupled to a rotational drive mechanism. The shaft can be supported by bearings. The bearing can be rigid or fluid in nature. When a fluid bearing is utilized, an amount of tilt of the impeller due to tilt play can lead to a reduced surface area of fan blades. The described embodiments can be applied in such a situation in a tolerance neutral manner when no increase in height is made to the trailing edge of each fan blade. As the trailing edge is the most likely portion of the fan blade to hit an inside surface of the fan housing as a result of tilt play when a parallel blade configuration is used, the fan blade can be optimized by linearly increasing the height of each fan blade moving away from the trailing edge. In this way, an entire portion of a top or bottom surface of the fan blade disposed beneath the fan housing has substantially the same amount of clearance from the fan housing given existing fan assembly tolerances. In such a case, the increase in height of the fan blade at the inlet radius is about the same as a maximum amount of tilt that can be experienced at the trailing edge of the fan blade. It should be noted that although a linear slope profile can be ideal, in some implementations a curved slope can be advantageously utilized.

In the case of a rigid bearing the fan blades can also be sloped; however, since a rigid bearing substantially prevents tilt play, the fan blades can have more surface area than fan blades configured in a similarly sized fluid bearing configuration. As a result, sloping of fan blades in a rigid bearing configuration can be limited by a fan blade height at which the fan blades begin to blow air back out of the fan inlet. By sizing the slope to prevent blowing air back out of the fan inlet an optimal slope can be configured, thereby maximizing airflow through the fan. It should be noted that the embodiments described herein can be applied to centrifugal fans and diagonal- or mixed-flow fans receiving air with both centrifugal and axial flow components.

With every successive generation of the product line, the processor is upgraded, which leads to increases in the cooling load in order to provide the consumer with an improved computing experience. This can easily be accomplished by increasing the fan speed in order to provide more airflow, however the increased fan speed and higher airflow typically cause an undesirable tradeoff for acoustic emissions, which adversely affect the user's computing experience. By using the embodiments disclosed herein that allow airflow to be maximized without affecting acoustic emissions, the user's computing experience can be substantially enhanced.

Figure 1B:
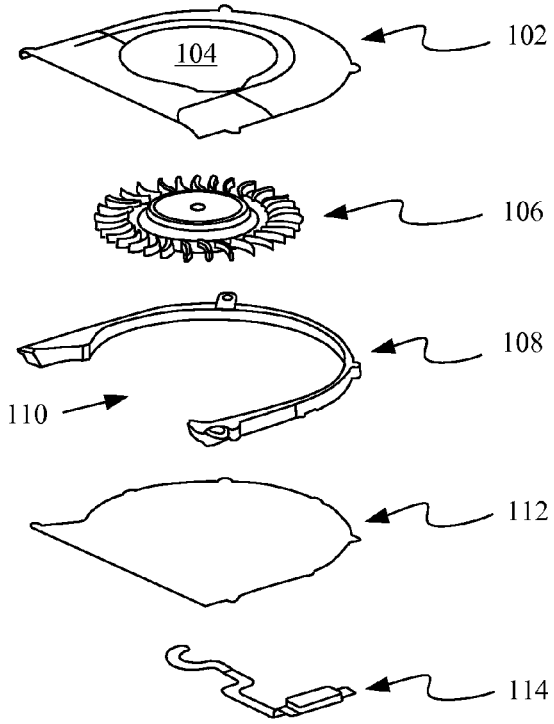

FIG. 1A shows a high performance centrifugal cooling fan 100 used in an ultra-slim notebook computer application that has been optimized for speed vs. flow characteristics in order to provide the desired cooling capacity within an acceptable acoustic performance limit. As product lines are refreshed and computing power is increased, the performance of the fan becomes inadequate and the design must be further optimized in accordance with the principal described above. FIG. 1B shows an exploded view of the cooling fan depicted in FIG. 1A with most of the component parts labeled for clarity. As depicted, top cover 102 provides an intake opening 104 for air to be sucked into centrifugal cooling fan 100 and also covers a top surface of rotor 106. Frame 108 surrounds an outer radius of rotor 106, leaving an opening 110 for air to be exhausted from centrifugal cooling fan 100. Bottom cover 112 covers a bottom surface of rotor 106; in some embodiments bottom cover 112 can also include an air intake. Finally, connector 114 can be configured to provide both power and a control signal to centrifugal cooling fan 100. It should be noted that while a centrifugal fan is used for exemplary purposes, the described embodiments can be related to a mixed flow fan having both centrifugal and axial flow components.

FIGS. 2A-2D show four partial cross-section views of the fan in FIG. 1, and define the various dimensions and tolerances that are used to determine minimum clearance distances between the fan blades and the covers. Tolerances corresponding to axial dimensions are denoted using the same letter as the dimensions, but in the lower case.

Figure 2A:
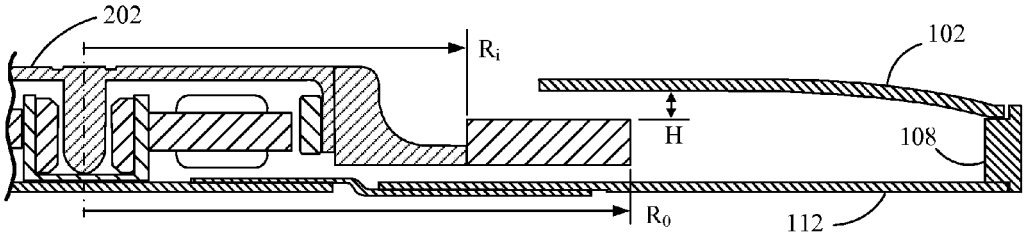
FIGS. 2A-2D show partial cross-sectional views of the centrifugal cooling fan depicted in FIG. 1A and partial cross-sectional views of fan subassemblies depicted in FIG. 1B.
Figure 2B:
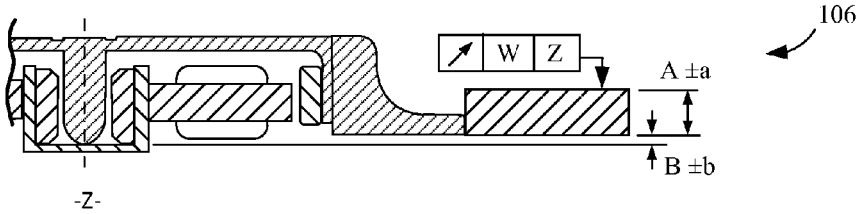
Figure 2C:
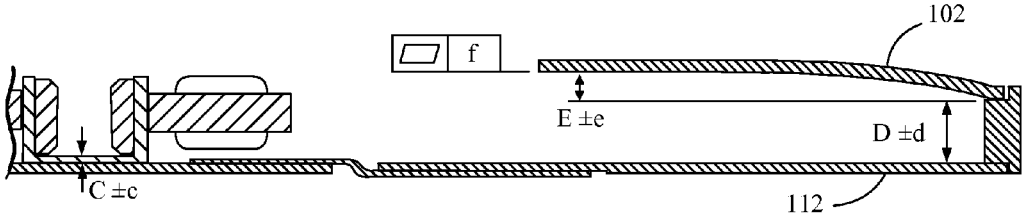
Figure 2D:
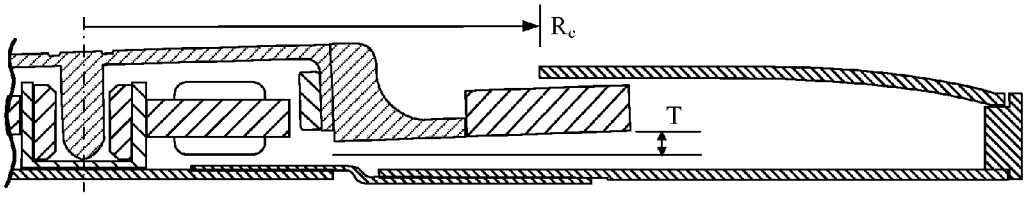

FIG. 2A shows a complete fans assembly with impeller 202 parallel to the covers as is typical during rotation of the fan when the fluid bearing is providing stiffness. The FIG. 2B depicts the fan rotor assembly only and shows the definition of the impeller runout tolerance W, which is commonly a function of injection molding tolerances and perpendicularity with the impeller shaft (defined as datum Z here). FIG. 2C shows the stationary portion of the fan assembly including top cover 102 and bottom cover 112. The flatness of the top cover is defined in this image. Other form tolerances such as surface profile are sometimes used instead. For calculation of H between the impeller blades and the bottom cover, the flatness or surface profile of the bottom cover would be used. In this example we are focusing our attention of the clearance H between the impeller blades and the top cover. The last image at the bottom of FIG. 2 shows the entire fan assembly at rest (not spinning) with the impeller tilted due to some external force applied (i.e. the user moving their notebook computer after turning it off).

Cover clearance H is generally a function of three parameters: 1) the cumulative stack-up of dimensions A-E, 2) the axial runout W of the impeller, and 3) the tilt play of the impeller at the blade tips due to clearances in the fluid bearing. The calculation of H defined in Eq. (1) guarantees sufficient clearance to avoid rubbing between the fan blades and cover during all operation modes of the fan including spin-up and spin-down.

$$H > \text{Bearing Tilt} + \text{Impeller Runout} + RSS\ \text{Tolerance Accrual} \quad \text{Eq. (1)}$$

$$[(E+D)-(A+B+C)] > T_{MAX} + W_{MAX} + \sqrt{a^2+b^2+c^2+d^2+e^2+(f/2)^2}$$

Figure 3:
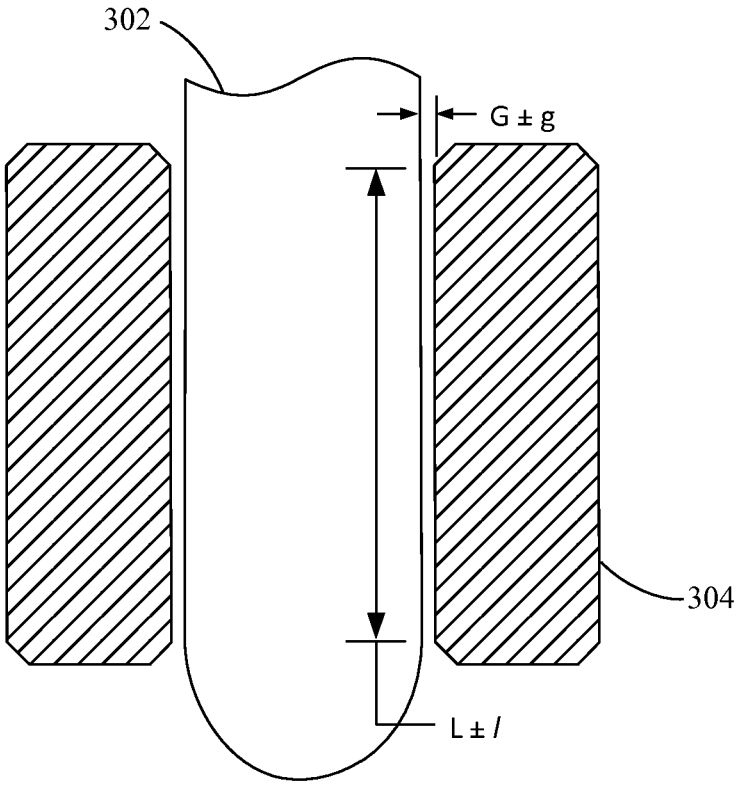
FIG. 3 shows a cross-sectional view of a fluid bearing for an impeller shaft.

FIG. 3 describes the fluid bearing in a cooling fan. For cooling fans that use a rigid bearing means such as preloaded ball bearings, the term $T_{MAX}$ in Equation 1 can be omitted. Omission of $T_{MAX}$ has a substantial benefit of providing a smaller clearance height H, and thereby taller blades. Unfortunately, the use of rigid ball bearings can adversely affect a fan assembly design with regards to compromises in acoustic performance and sensitivity to bearing damage and related noise. For cooling fans that take advantage of much quieter fluid bearings such as the fan in FIG. 1, there is a certain amount of tilt play T in the impeller due to the fluid bearing's stiffness being zero when at rest (not spinning). This is especially of concern when the computer user shuts down a notebook computer and moves the system while the fan is spinning down to zero RPM. The term $T_{MAX}$ in Equation 1 can be calculated using Equation 2, which discloses ways of determining fan impeller tilt. Tolerance variable G is a designed bearing gap between impeller shaft 302 and bearing sleeve 304. Tolerance variable L represents a designed bearing bore length.

$$T = \frac{2G}{L}R_0 \quad \text{Eq. (2)}$$

$$T_{MAX} = \frac{2(G+g)}{(L-l)}R_0$$

Because the minimum blade-cover clearance H is a function of the impeller tilt play at the blade tips, the height of the impeller blades is constrained by the potential point of contact with the cover at the trailing edge radius $R_O$. The top and bottom edges of the blades inboard of $R_O$ need not be constrained to the same height limitation and can therefore be modified to create more blade surface area and thereby more air flow to cool the computer system. Realization that the height constraint only applies at the blade tips creates an opportunity to increase the blade height in other areas without having to undergo costly tightening of tolerances a-f as required by Equation 1. A "tolerance-neutral" method for increasing the blade height is the subject of the embodiments described herein.

Figure 4:
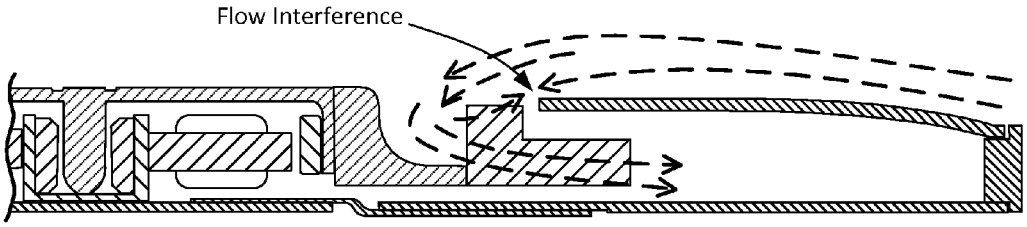
FIG. 4 shows an airflow profile for a stepped fan blade configuration.

FIG. 4 shows one configuration for increasing the blade height inboard of the cover inlet so that there is no impact to assembly tolerances. This approach is unsuccessful due to air driven by the stepped blade sections being forced back out through the fan inlet and further impeding inlet air from entering the impeller. This outflow from the stepped blade sections leads to internal recirculation and to the development of increased shear stress, and therefore turbulence which, in this instance, is detrimental to flow and acoustic performance. The degraded fan cooling performance therefore negated the other benefit of being tolerance-neutral. The dashed arrows in the figure indicated airflow path over the top cover, into the inlet, and centrifugally outward between the fan blades.

Figure 5:
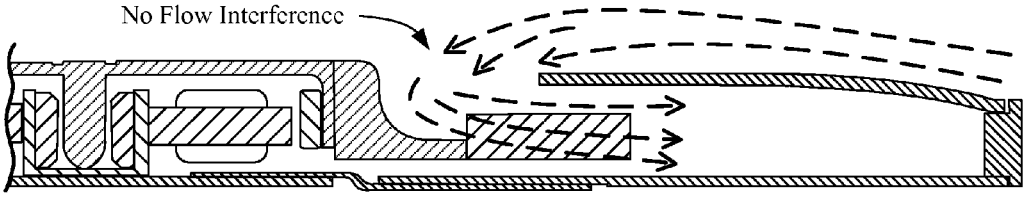
FIG. 5 shows an airflow profile for the cooling fan depicted in FIGS. 1A-1B.

FIG. 5 shows the airflow path through the cooling fan depicted in FIG. 1. The blade height is small enough to avoid "throwing" air back into the path of incoming air, so the airflow is not compromised by recirculation.

Figure 6A:
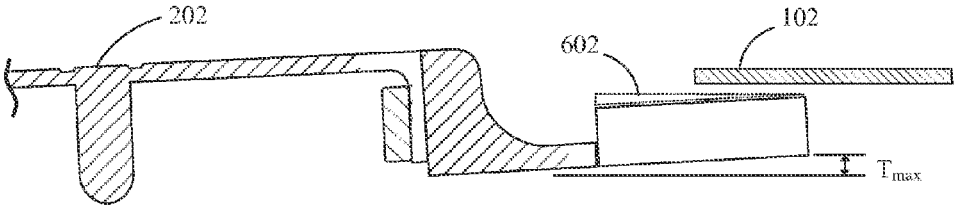
FIGS. 6A-6D show how an optimal blade slope can be determined for a cooling fan.
Figure 6B:
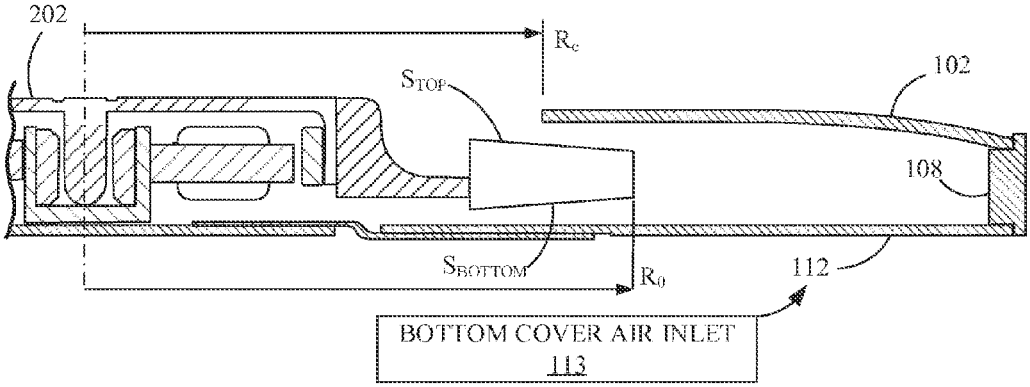
Figure 6C:
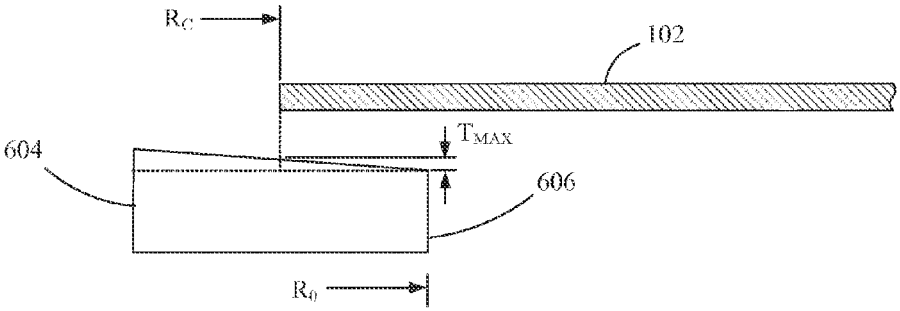

FIGS. 6A-6C describes a tolerance-neutral approach to increasing the blade height and surface area that involves sloping the blade top and/or bottom edges upward starting from the blade trailing edge $R_O$ and going toward the cover inlet radius $R_C$. By following this method, the blade is sloped optimally such that the blade-cover clearance H is still constrained by the blade tips and therefore the tolerance requirements are unchanged vs. the cooling fan depicted in FIG. 1. Also, the flow interference issue described in FIG. 4 is avoided. It should be noted that while only the top blade edge is shown sloped in this series of figures, sloping a bottom edge of the blades can be appropriate when bottom cover 112 includes an air inlet 113.

$$S = \frac{T_{MAX}}{R_0 - R_C} \quad \text{Eq. (3)}$$

Figure 6D:
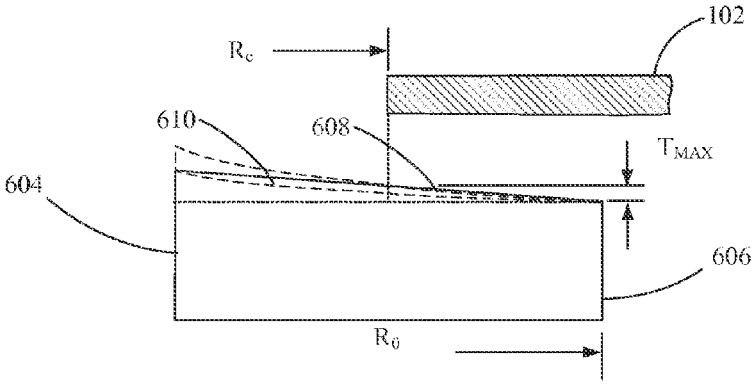

FIG. 6A shows the fan rotor assembly tilted by the amount $T_{MAX}$ as described in FIG. 2 and defined in Equation 2. There is a triangular zone 602 between the blade top edge and top cover 102 that can be added to the blade geometry without impacting the required cover clearance at the blade tips. FIG. 6B shows a preferred embodiment of the cooling fan with blade top edges angled according to an optimal slope S. FIG. 6C defines how the optimal slope S is calculated using Eq. (3). It should be noted that slope S can be defined in more specific terms in relation to a top edge or a bottom edge of the blade. For example, referring to a top edge of the blade, the corresponding slope can be referred to as top slope $S_{top}$, whereas a bottom edge of the blade can have a corresponding slope of $S_{bottom}$. It should be further noted that a fan blade can be configured in such a way as to possess only a sloped top edge or only a sloped bottom edge or in some cases, both top and bottom edges of the fan blade can be sloped. The value of the slope can be linear or non-linear so long as a portion of the fan blade disposed outboard of cover inlet radius $R_C$ does not exceed a height profile defined by Eq. (3). In this depiction a difference in height between leading edge 604 and trailing edge 606 of the fan blade defines a slope of a top edge of the fan blade. The slope can be optimized when a change in height between leading edge 604 and trailing edge 606 of the fan blade is shaped in accordance with Eq. (3), as depicted. Using this method, the airflow of the cooling depicted in FIG. 1 was increased significantly without impacting component and assembly tolerances and also without compromising acoustic performance. Although Eq. (3) provides an optimal slope for the fan blades between trailing edge 606 and cover inlet radius $R_C$, it should be noted that other configurations increasing blade surface area are also possible and fall under the scope of this disclosure. For example, FIG. 6D shows alternate surfaces 608 and 610 depicted by dotted lines. While neither dotted line is linear, they are still operable to increase the surface area of the blade without exceeding the constraint provided by Eq. (3). By increasing the height of each blade with respect to a conventional parallel blade structure without exceeding the slope provided by Eq. (3) a surface area of the blades can be increased without having to increase any tolerances of the fan assembly.

Figure 7:
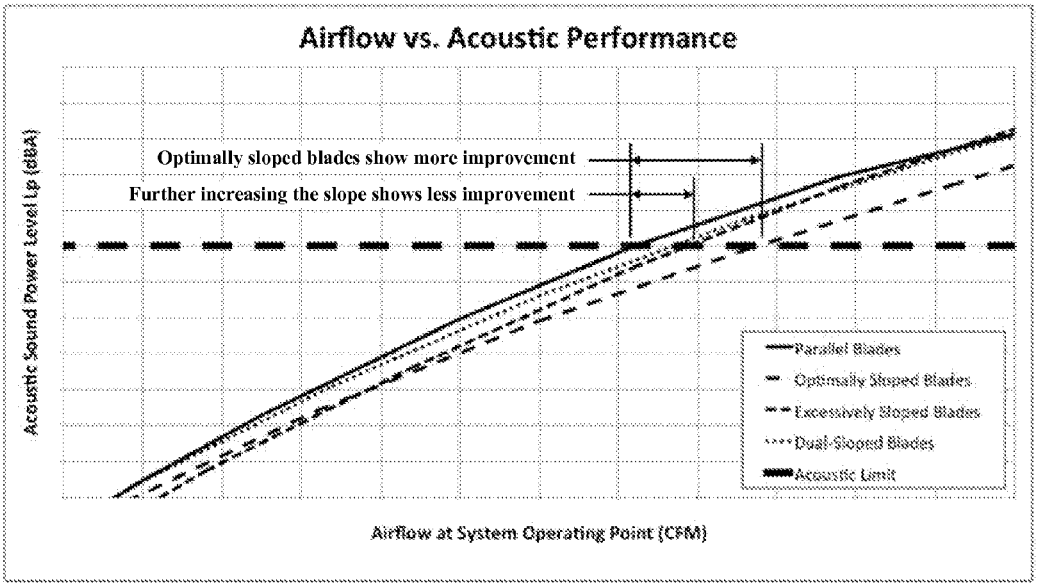
FIG. 7 shows performance profiles for various fan blade geometries.
Figure 8A:
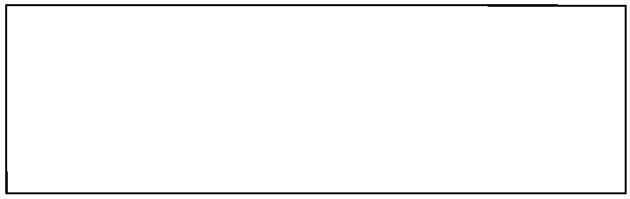
FIGS. 8A-8D show the fan blade geometries associated with the performance profiles depicted in FIG. 7.
Figure 8B:
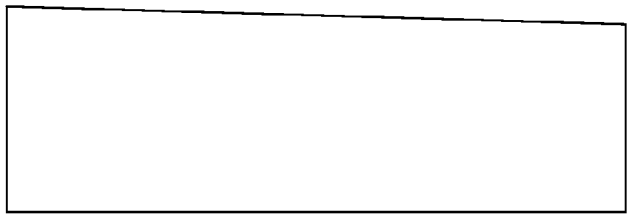
Figure 8C:
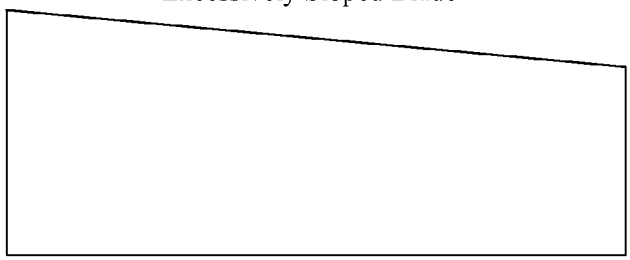
Figure 8D:
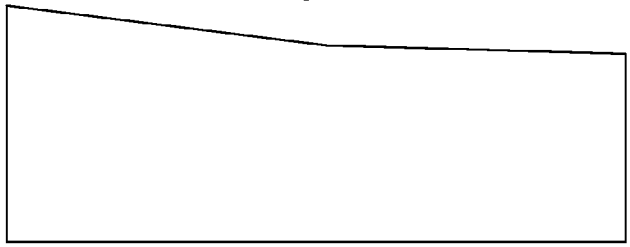

FIG. 7 shows actual test results from prototyping the blade designs with varying slope vs. the parallel blade design depicted in FIG. 5. All fan blade candidate designs are operated at a maximum acceptable acoustic limit and then compared for flow performance. The design with the fan blades sloped according to the method described in FIGS. 6A-6C, labeled as "Optimally Sloped Blades" in the chart, showed the biggest gain vs. the baseline "Parallel Blades" design. Based on the improved performance associated with sloping the blades, an increased slope was also prototyped and the results were not as good (see "Excessively Sloped Blades" and "Dual-Sloped Blades" in FIG. 7).

Figure 9:
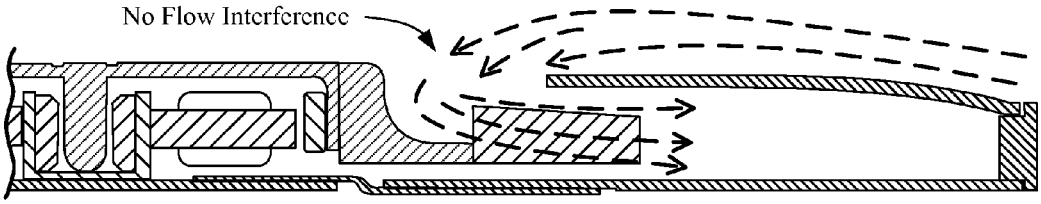
FIG. 9 shows an airflow profile for a fan blade configuration with an optimal slope.
Figure 10:
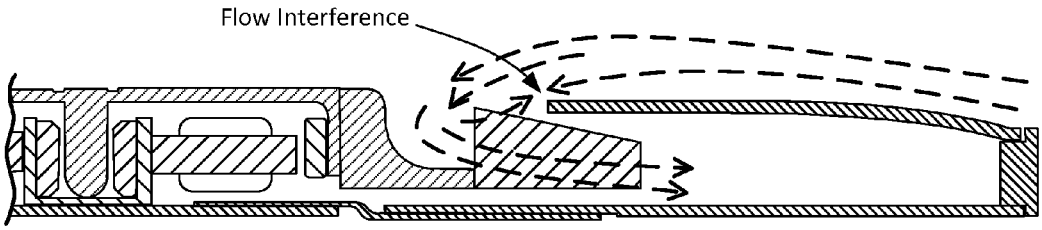
FIG. 10 shows an airflow profile for a fan blade configuration with an excessive slope.

The shapes of the sloped blades tested in FIG. 7 are shown in FIGS. 8A-8D. The "Dual-Sloped" case depicted in FIG. 8C was included because it is another tolerance-neutral embodiment since the outer slope conforms to the calculation in Equation 3, but inboard of the fan inlet radius $R_C$ the slope is further increased to achieve even greater blade surface area. Adding more blade surface area should in theory increase the airflow, however 8*c* and 8*d* did not perform as well as 8*b* as shown in chart of FIG. 7. This is likely due to the same flow interference problem described in FIG. 4 previously. FIG. 9 describes the case where the blade slope is sufficient to increase airflow, but is not so great that blade-driven air starts to flow back toward incoming air. FIG. 10 describes the case in which the blade slope is excessive and causes the leading edges to rise high enough to drive air back into the incoming flow path, which can be counterproductive.

The various aspects, embodiments, implementations or features of the described embodiments can be used separately or in any combination. The advantages of the invention are numerous. Different aspects, embodiments or implementations may yield one or more of the following advantages. One advantage of the invention is that the fan in the device can be much quieter and less annoying to a user. The thermal performance of fans that utilize the fan embodiments described herein is increased with respect to fans that do not use the described embodiments. Another advantage of these fans is performance increase can be obtained without having to increase an overall size of the fan assembly.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A centrifugal fan assembly for cooling a computing device, comprising:

a fan assembly housing, comprising:

a top cover; and a rotor, comprising:

a shaft mechanically coupled to a rotational drive, the rotational drive configured to impart a rotational force on the shaft, causing the shaft to rotate at a rotational velocity, and an impeller centrally attached to the shaft comprising a fan blade at an outside perimeter of the impeller, the fan blade comprising a leading edge, a trailing edge, a top edge disposed between the leading and trailing edge, and a bottom edge disposed between the leading edge and trailing edge, the top edge characterized as having a top slope $S_{top}$ that prevents contact between the top edge and the top cover, the top slope $S_{top}$ corresponding to a height of the leading edge being greater than that of the trailing edge, the bottom edge characterized as having a bottom slope $S_{bottom}$ corresponding to the height of the leading edge being greater than the height of the trailing edge, wherein the shaft is mechanically coupled to the rotational drive by a fluid bearing, and wherein the top slope $S_{top}$ results in a minimum cover clearance between the top edge and the top cover along at least a portion of the top edge length when the impeller experiences a maximum possible tilt relative to the top cover.

2. The centrifugal fan assembly as recited in claim 1, wherein the top cover comprises an airflow inlet, and wherein the top slope $S_{top}$ is about the same as the maximum amount of tilt divided by a radial distance between the trailing edge of the fan blade and an inlet radius of the airflow inlet.

3. The centrifugal fan assembly as recited in claim 2, wherein the fan assembly housing further comprises a bottom cover having an airflow inlet, and wherein the bottom slope $S_{bottom}$ corresponds to the maximum amount of tilt.

4. The centrifugal fan assembly as recited in claim 3, wherein the bottom slope $S_{bottom}$ is linear.

5. The centrifugal fan assembly as recited in claim 3, wherein the bottom slope $S_{bottom}$ is non-linear.

6. The centrifugal fan assembly as recited in claim 1, wherein the top slope $S_{top}$ corresponds to the leading edge having a height that maximizes blade area without inducing flow interference.

7. The centrifugal fan assembly as recited in claim 1, wherein the top slope $S_{top}$ is linear.

8. The centrifugal fan assembly as recited in claim 1, wherein the top slope $S_{top}$ is non-linear.

9. A rotor assembly, comprising:

a shaft mechanically coupled to a rotational drive, the rotational drive configured to impart a rotational force on the shaft, causing the shaft to rotate at a rotational velocity; and an impeller centrally attached to the shaft comprising a fan blade at an outside perimeter of the impeller, the fan blade comprising a leading edge, a trailing edge and a bottom edge disposed between the leading and trailing edge, the bottom edge characterized as having a bottom slope $S_{bottom}$ that prevents contact between the bottom edge and an associated fan housing having an air inlet disposed proximate to the bottom edge, the bottom slope $S_{bottom}$ resulting in no more than a constant minimum cover clearance between the bottom edge and the associated fan housing along at least a non-point portion of the bottom edge length when the impeller experiences a maximum amount of tilt.

10. The rotor assembly as recited in claim 9, wherein the rotor assembly is a subassembly in a mixed flow fan assembly having at least centrifugal flow and axial flow components.

11. The rotor assembly as recited in claim 9, wherein the air inlet disposed proximate to the bottom edge is disposed in a central portion of a bottom cover of the associated fan housing.

12. The rotor assembly as recited in claim 11, wherein the shaft is mechanically coupled to the rotational drive by a fluid bearing.

13. A fan assembly, comprising:

a housing comprising a top cover having an air inlet; and an impeller supported by bearings that are configured to constrain the impeller to a single axis of rotation during operation of the fan assembly, the impeller comprising:

a fan blade configured to draw air into the air inlet and to blow air back out of an air outlet, the fan blade comprising:

a trailing edge, a leading edge having a height greater than the trailing edge, and a top surface disposed between the leading edge and the trailing edge, the top surface having a top slope $S_{top}$ that maximizes blade area of the fan blade disposed outboard of the air inlet while preventing contact between the top surface and the top cover, wherein the top surface is parallel to the top cover along the top surface length when a maximum amount of tilt is experienced by the fan blade.

14. The fan assembly as recited in claim 13, wherein the bearings are fluid bearings.

15. The fan assembly as recited in claim 13, wherein the top slope Stop is linear.

* * * * *